US005775962A

United States Patent [19]

Kakuta et al.

[11] Patent Number: 5,775,962

[45] Date of Patent: Jul. 7, 1998

[54] JOINING STRUCTURE FOR BOX-SHAPED PORTION OF TERMINAL LUG

[75] Inventors: Naoki Kakuta; Takeya Miwa, both of Shizuoka, Japan

[73] Assignee: Yazaki Corporation, Tokyo, Japan

[21] Appl. No.: 744,194

[22] Filed: Nov. 5, 1996

[30] Foreign Application Priority Data

Nov. 8, 1995 [JP] Japan ..... 7-289856

[51] Int. Cl.[6] ..... H01R 11/22

[52] U.S. Cl. ..... 439/852

[58] Field of Search ..... 439/843, 844, 439/845, 847, 849, 850, 852, 853

[56] References Cited

U.S. PATENT DOCUMENTS 4,934,966 6/1990 D'Urso ..... 439/849

4,950,183 8/1990 Watanabe et al. ..... 439/852

5,643,018 7/1997 Sakai et al. ..... 439/852

*Primary Examiner*—Gary F. Paumen

*Assistant Examiner*—Yong Ki Kim

*Attorney, Agent, or Firm*—Armstrong, Westerman, Hattori, McLeland & Naughton

[57] ABSTRACT

A joining structure for a box-shaped portion of a terminal lug used in electric wiring. One of the walls constituting the box-shaped portion is at the end provided with a locking claw, and the other wall is at the corresponding end provided with a locking hole into which the locking claw is fitted to join the walls to each other. The joining structure for the box-shaped portion of a terminal lug realizes a joint of high strength, enables a terminal lug to become small in size and light in weight, and is reliable.

6 Claims, 6 Drawing Sheets

JOINING STRUCTURE FOR BOX-SHAPED PORTION OF TERMINAL LUG

BACKGROUND OF THE INVENTION

1. Field of the Invention

This invention relates to a joining structure for a box-shaped portion of a terminal lug formed by bending a thin metallic plate.

2. Description of the Related Art

Conventional terminal lugs used in the connection of an electric circuit include, for example, a female terminal lug T as shown in FIG. 7, which is provided with a box-shaped portion a for receiving a mating terminal lug therein.

To produce the terminal lug T, a thin metallic plate is pressed to punch out a developed body corresponding to one terminal lug T, followed by bending the developed body so that lateral ends a1 and a2 are in facing relationship to each other in the formed box-shaped portion a, or that, as shown in FIG. 8, top walls overlie each other, with a hole c formed in one wall b of the box-shaped portion a and a locking claw d1 projecting at the end of the other wall d fitted in the hole c.

With the joining structure as shown in FIG. 7, however, if such a force is applied from inside the box-shaped portion a so as to spread the box-shaped portion a, the ends a1 and a2 easily separate from each other to open as shown in FIG. 9. Likewise, with the fit-in structure as shown in FIG. 8, if a force is applied to spread the box-shaped portion a, the locking claw d1 tends to be disengaged from similar hole c, resulting in an insufficient strength and the for the joining structure and poor reliability.

SUMMARY OF THE INVENTION

The present invention has been accomplished to overcome the above-described drawbacks and an object of the present invention is to provide a joining structure for the box-shaped portion of a terminal lug, which provides a joint of high strength, enables a terminal lug to become small in size and light in weight, and is of high reliability.

In order to attain the above-mentioned object, according to the present invention, a joining structure for a box-shaped portion of a terminal lug is provided. The joining structure for the box-shaped portion of the terminal lug is formed by bending a thin metallic plate, which comprises: two walls constituting the box-shaped portion; a locking claw provided at an end of one of the walls; a locking hole provided at a corresponding end of the other of the walls; wherein the locking claw is fitted into the locking hole to join the ends of the respective walls to each other.

Preferably, the box-shaped portion is an electric contact portion of a female terminal lug in which a male terminal lug is received.

Preferably, the box-shaped portion is located behind a male electric contact portion of a male terminal lug.

The above and other objects, features and advantages of the present invention will become apparent from the following description and the appended claims, taken in conjunction with the accompanying drawings in which like parts or elements are denoted by like reference characters.

DESCRIPTION OF THE PREFERRED EMBODIMENT

Embodiments of the present invention will now be described with reference to the attached drawings.

Figure 1:
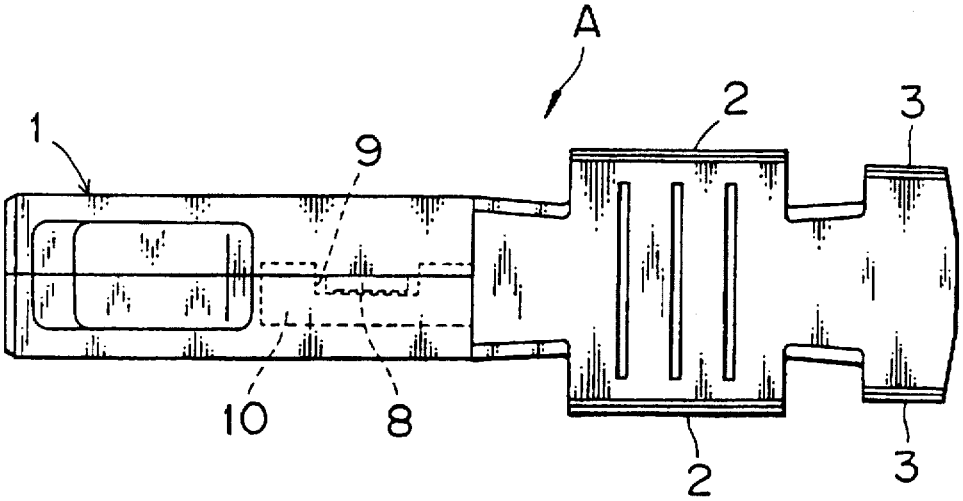
FIG. 1 is a plan view of a female terminal lug according to a first embodiment of the present invention.
Figure 2:
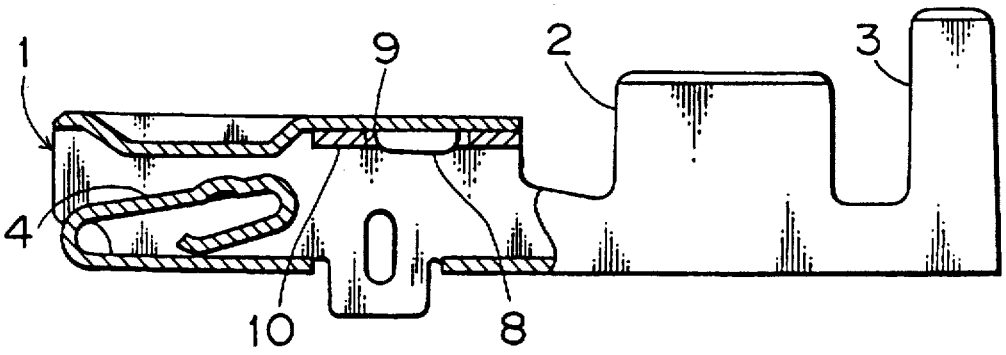
FIG. 2 is a partially cutaway side view of the terminal lug as shown in FIG. 1.
Figure 3:
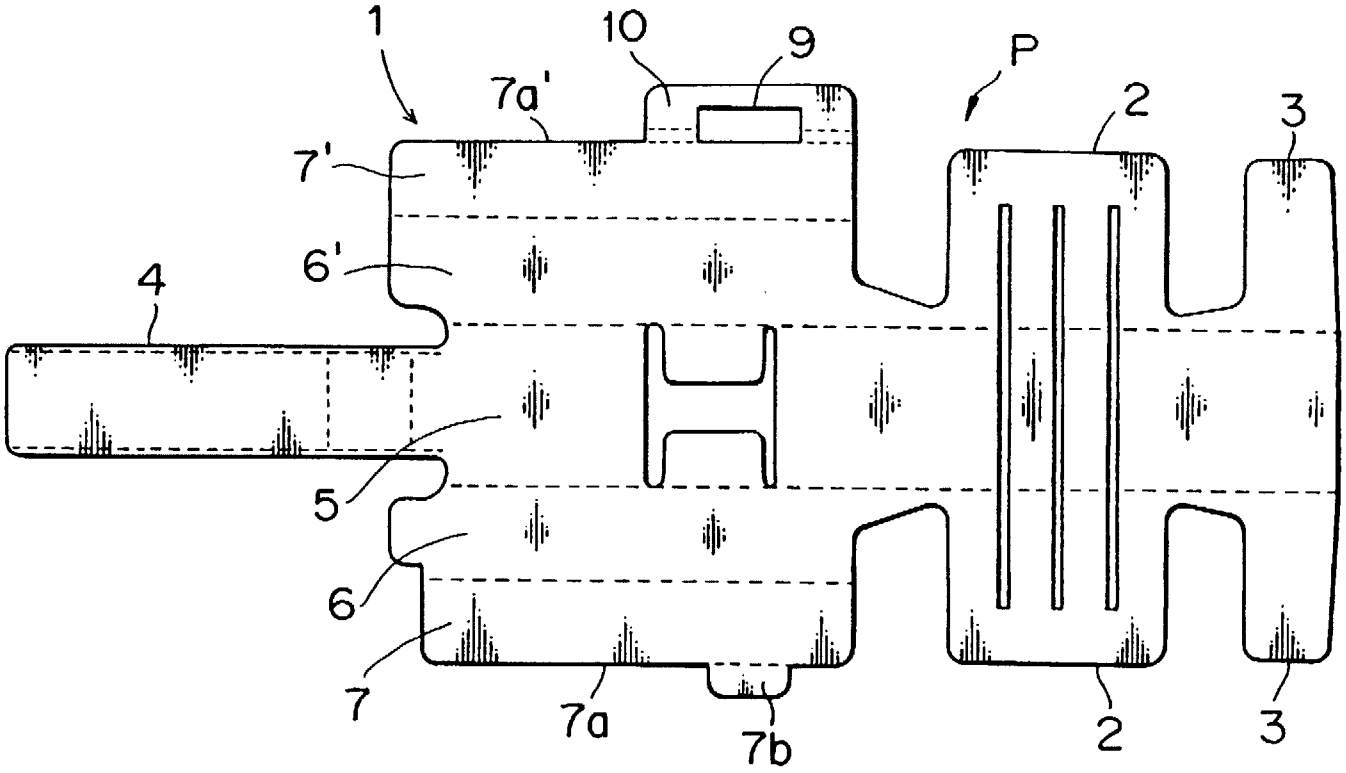
FIG. 3 is a plan view of a developed body for forming the terminal lug as shown in FIG. 1, which is produced by punching a conductive metallic plate.

Referring to FIGS. 1 and 2, a terminal lug A has an electrically-contacting box-shaped portion 1 for receiving a mating male terminal lug at a front portion thereof, and two longitudinally spaced pairs of opposed upstanding crimped pieces 2, 2 and 3, 3, at a rear portion thereof. The electrically contacting box-shaped portion 1 is for connection with an electric wire and the crimped pieces are for holding the insulation of the electric wire. The terminal lug A is formed by punching a developed body P, as shown in FIG. 3, out of a conductive metallic plate and thereafter bending the same. A resilient piece 4 is for holding the male terminal lug which has been inserted in place.

Figure 4:
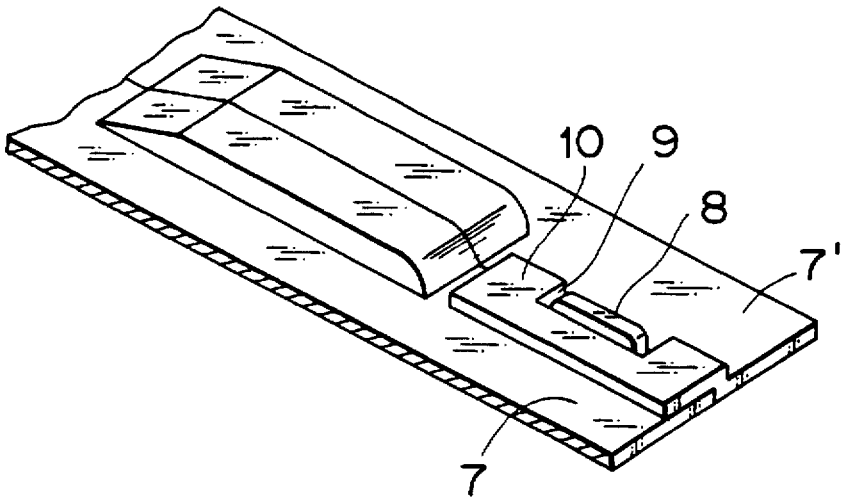
FIG. 4 is a perspective view of the joint of the terminal lug as shown in FIG. 1, as viewed from the inside.
Figure 5:
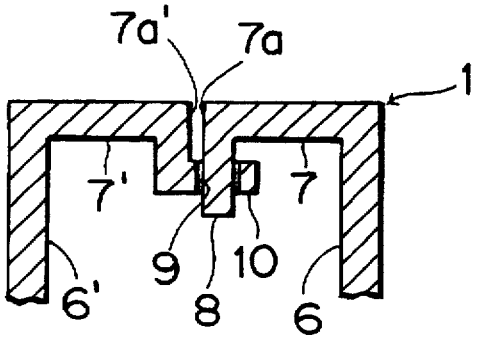
FIG. 5 is an explanatory cross-sectional view of the joint of the terminal lug as shown in FIG. 1.

The developed body P has a bottom wall 5, side walls 6, 6' and top walls 7, 7' for forming the box-shaped portion 1. One top wall 7 is formed with a projection 7*b* at lateral end 7*a* thereof to function as a locking claw 8, and the other top wall 7' is provided with a projection 10 at lateral end 7*a*' thereof. The projection 10 has a locking hole 9 into which the locking claw 8 is inserted for joining the top wall 7 to the top wall 7'. The developed body P is bent along dotted lines in FIG. 3 to provide a rectangular hollow shape, and as shown in FIGS. 4 and 5, the projection 7*b* is bent at substantially right angles to the top wall 7 to form the locking claw 8 and inserted into the locking hole 9. Thus, the lateral ends 7*a* and 7*a*' of the respective top walls 7 and 7' respective, are joined to each other to provide the box-shaped portion 1.

In the box-shaped portion 1, as shown in FIG. 5, at an intermediate position between the side walls 6 and 6', the lateral ends 7*a* and 7*a*' of the respective top walls 7 and 7' are joined to each other by the locking claw 8 inserted into the locking hole 9. Thus, if an external force is applied so as to spread the side walls 6, 6' apart from each other, the locking claw 8' inserted into the locking hole 9' prevents the separation of the top walls 7, 7', thereby ensuring a firm joining between the top walls 7 and 7'.

Figure 6:
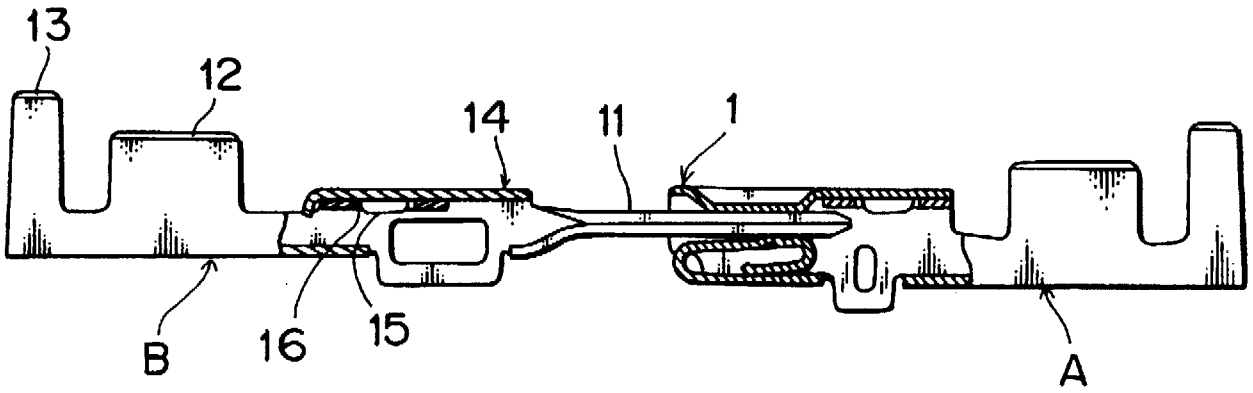
FIG. 6 is a partially cutaway side view of a male terminal lug according to a second embodiment of the present invention, shown fitted in the female terminal lug as shown in FIG. 1.
Figure 7:
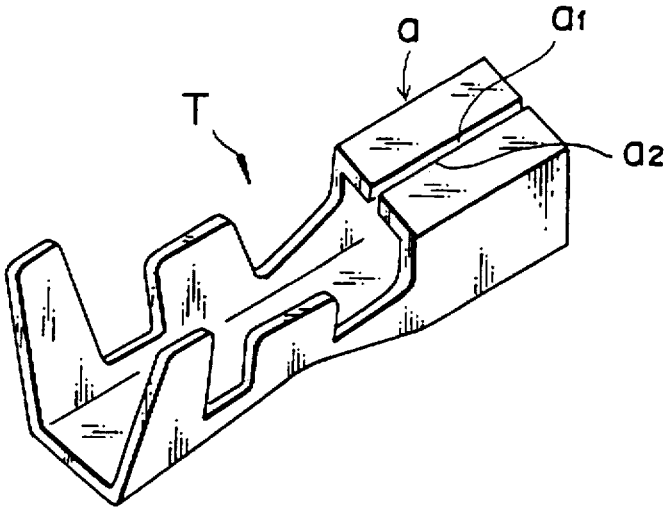
FIG. 7 PRIOR ART
FIG. 7 is a perspective view showing a first conventional joining structure for the box-shaped portion of a terminal lug.
Figure 8:
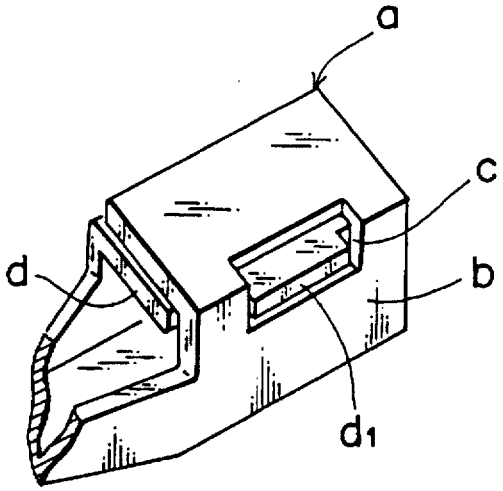
FIG. 8 PRIOR ART
FIG. 8 is a perspective view showing second conventional joining structure for the box-shaped portion of a terminal lug.
Figure 9:
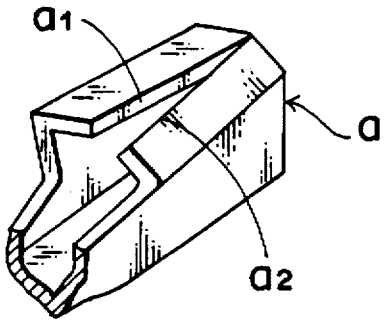
FIG. 9 PRIOR ART
FIG. 9 is an explanatory view of the box-shaped portion of FIG. 7 in a state out of the joint.
Figure 10:
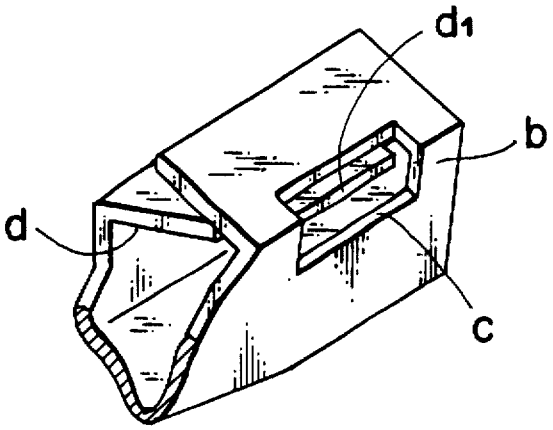
FIG. 10 PRIOR ART
FIG. 10 is an explanatory view of the box-shaped portion of FIG. 8 in a state out of the joint.

Referring to FIG. 6, a male terminal lug B according to a second embodiment of the present invention has a male terminal 11 at a front end thereof. The male terminal 11 is insertable into the box-shaped portion 1 of the terminal lug A. The male terminal lug B also has two longitudinally-spaced pairs of opposed upstanding crimped pieces 12 and 13 at a rear portion thereof. The male terminal lug B also has a box-shaped portion 14 at an intermediate portion between the front and rear portions thereof. The box-shaped portion 14 is for joining the top wall 7 to the top wall 7'.

The box-shaped portion 14 has substantially the same structure as that of the above-mentioned box-shaped portion 1 of the terminal lug A. The box-shaped portion 14 includes top walls each having a locking claw 15 and a locking hole 16 at lateral ends thereof, respectively, being engageable with each other. Thus, a detailed description of the box-shaped portion 14 will be omitted. Even a male terminal lug B can be provided with such a box-shaped portion 14 for realizing firm joining and high reliability.

Having now fully described the present invention, it will be apparent to one of ordinary skill in the art that many changes and modifications can be made thereto without departing from the spirit and scope of the invention as set forth herein.

What is claimed is:

1. A joining structure for a box-shaped portion of a terminal lug formed by bending a thin metallic plate, comprising:

first and second walls constituting a part of said box-shaped portion;

a locking claw provided at first end of said first wall;

a locking hole provided at a first end of said second wall, wherein said locking claw is fitted into said locking hole to join said first ends of said first and second walls to each other, and wherein said locking claw is bent at a substantially right angle to said first wall, and said locking hole opens in such direction as to allow said locking claw to fit therein to.

2. The joining structure according to claim 1, wherein said first and second walls each include a top wall portion, and said locking claw and said locking hole are provided at ends of said top wall portions of said first and second walls, respectively.

3. The joining structure according to claim 1, wherein said locking hole is formed in a projection provided at said first end of said said second wall.

4. The joining structure according to claim 1, wherein said terminal lug, including said box-shaped portion, is of a one-piece metallic plate.

5. The joining structure according to claim 1, wherein said box-shaped portion is an electric contact portion of a female terminal lug for receiving therein a male terminal lug.

6. The joining structure according to claim 1, wherein said box-shaped portion is located behind a male electric contact portion of a male terminal lug.

* * * * *